US006141840A

United States Patent [19]

Berkes

[11] Patent Number: 6,141,840

[45] Date of Patent: Nov. 7, 2000

[54] BUCKLE FOR RETRACTABLE RESTRAINTS

[75] Inventor: James R. Berkes, Brecksville, Ohio

[73] Assignee: Artisan Tool & Die Corporation, Cleveland, Ohio

[21] Appl. No.: 09/324,154

[22] Filed: Jun. 2, 1999

[51] Int. Cl.[7] ..... A44B 11/25; A44B 21/00

[52] U.S. Cl. ..... 24/633; 24/68 CD; 24/641; 24/647

[58] Field of Search ..... 24/633, 636, 641, 24/643, 909, 68 CD

[56] References Cited

U.S. PATENT DOCUMENTS

| | | | |
|---|---|---|---|
| 3,425,103 | 2/1969 | Melin | 24/633 |
| 4,001,532 | 1/1977 | Kubota et al. | 24/647 |
| 4,638,533 | 1/1987 | Gloomis et al. | 24/633 |
| 4,715,096 | 12/1987 | Fleming et al. | 24/641 |

FOREIGN PATENT DOCUMENTS

| | | | |
|---|---|---|---|
| 0920365 | 3/1963 | United Kingdom | 24/641 |
| 1369552 | 10/1974 | United Kingdom | 24/633 |

*Primary Examiner*—Victor N. Sakran

*Attorney, Agent, or Firm*—Renner, Otto, Boisselle & Sklar, LLP

[57] ABSTRACT

A buckle for releasably engaging a tongue of a restraint system and the like includes a housing containing a latch having a forward edge pivotally connected to a forward end of the housing. Overlying the latch is a lever that is pivotally connected to the housing intermediate opposite ends of the lever. Interposed between the housing and latch is a leaf spring that urges a back edge of the latch upwardly within the housing and into engagement with a rear end portion of the lever rearwardly of the pivotal connection between the lever and housing for urging a front end portion of the lever forwardly of the pivotal connection toward the housing. A raised rearwardly facing shoulder on the latch is engageable by a wall of a slot in the tongue when the tongue is inserted into the buckle between the lever and latch for retaining the tongue within the buckle. To release the tongue from the buckle, the front end portion of the lever is lifted upwardly to cause the rear end portion of the lever to press downwardly against the back edge of the latch, causing the back edge of the latch to move downwardly within the housing until upward projections on the housing disengage the tongue from the rearwardly facing shoulder.

20 Claims, 2 Drawing Sheets

BUCKLE FOR RETRACTABLE RESTRAINTS

FIELD OF THE INVENTION

This invention relates generally to a new buckle design for retractable restraints used to restrain loads on reusable pallets and the like.

BACKGROUND OF THE INVENTION

It is generally known to use retractable restraints to restrain loads on reusable pallets and the like. One advantage retractable restraints have over conventional banding or shrink wrapping of loads on pallets is that retractable restraints are designed to be used over and over again thus eliminating the substantial waste that is produced when the banding or shrink wrap is removed from the pallets. Also, retractable restraints eliminate the labor, materials and equipment needed to band or shrink wrap loads on pallets.

An objection to previous retractable restraints is that the pushbutton type buckles that are currently being used to releasably secure the restraints in place are hard to release when the restraints ratchet and tighten up due to vibrations and the like that occur during shipment of the pallets by truck or rail. The greater the tension on the restraints, the greater the amount of pressure that must be applied to the pushbuttons to release the buckles.

In some cases the pressure needed to release the buckles is so great that the operator may end up cutting the restraints to release the load, rendering the restraints no longer reusable. Applying the required pressure to the pushbuttons to release the buckles is particularly difficult when the buckles are located near the bottom of the pallets close to the ground. Also, the buckles currently in use consist of a number of parts that are somewhat difficult to assemble, making them relatively expensive to manufacture.

SUMMARY OF THE INVENTION

In accordance with one aspect of the invention, the buckle of the present invention requires very little force to be applied to release the restraints even when the restraints are overly tight due to vibrations and the like during shipping.

In accordance with another aspect of the invention, the buckle is comprised of very few parts that are relatively inexpensive to manufacture and easy to assemble.

In accordance with another aspect of the invention, the buckle includes a common leaf spring that provides pressure both to the catch and release lever of the buckle.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
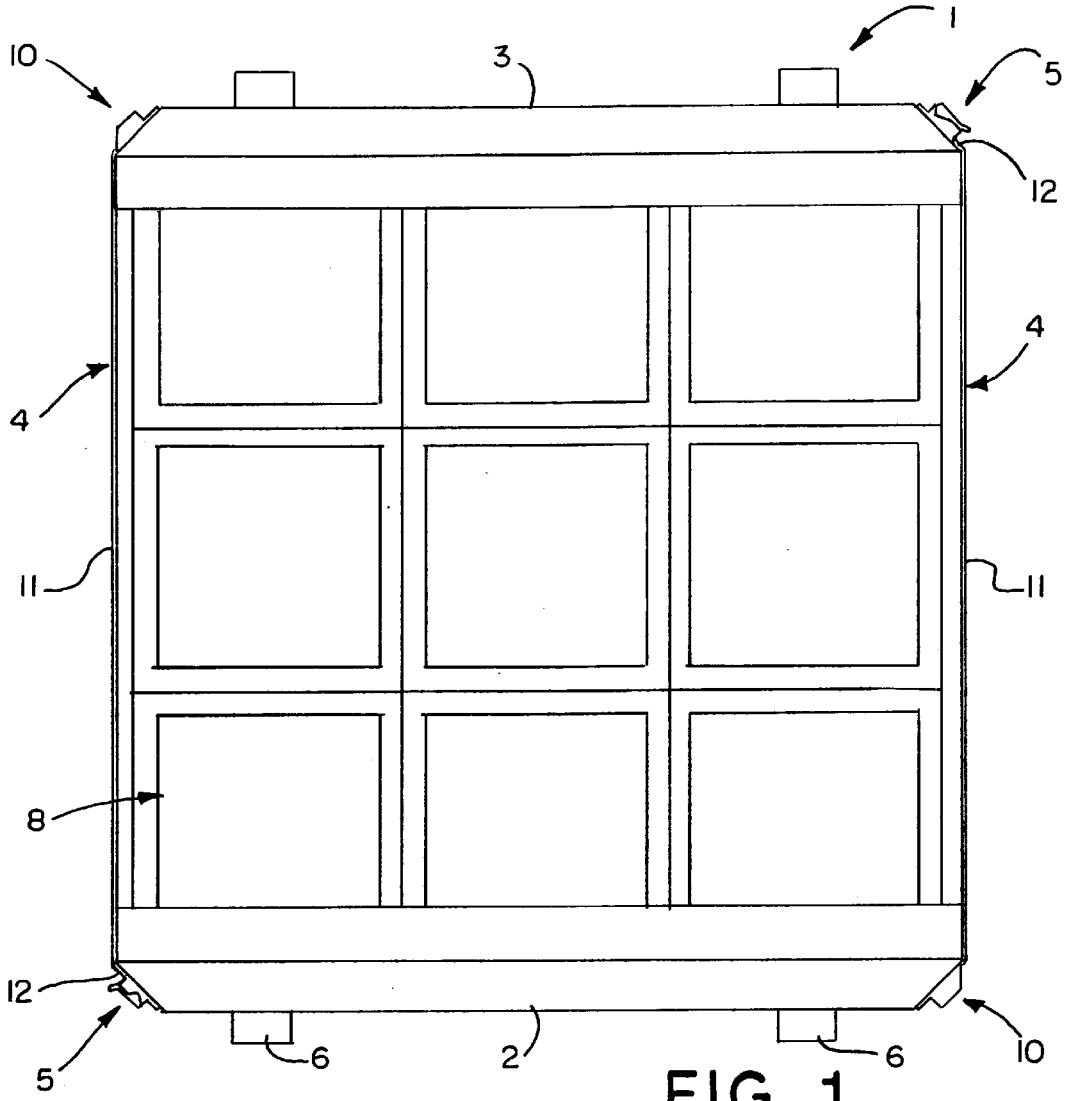
FIG. 1 is a schematic side elevation view of one known type of reusable pallet system including a top cover and bottom pallet releasably connected together to restrain a load thereon using a pair of reusable cargo restraints, each of which may include a buckle made in accordance with the present invention.
Figure 2:
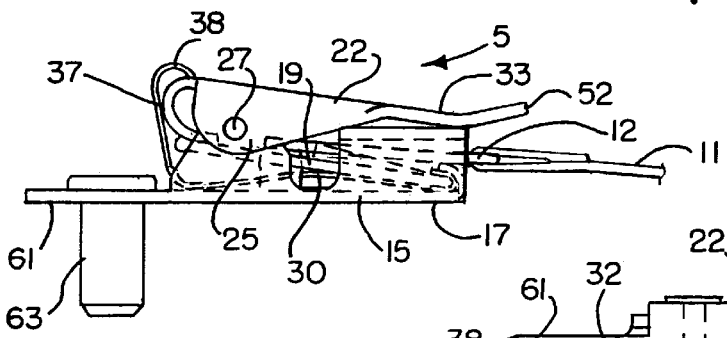
FIG. 2 is an enlarged side elevation view of the buckle of the present invention in its closed position.
Figure 3:
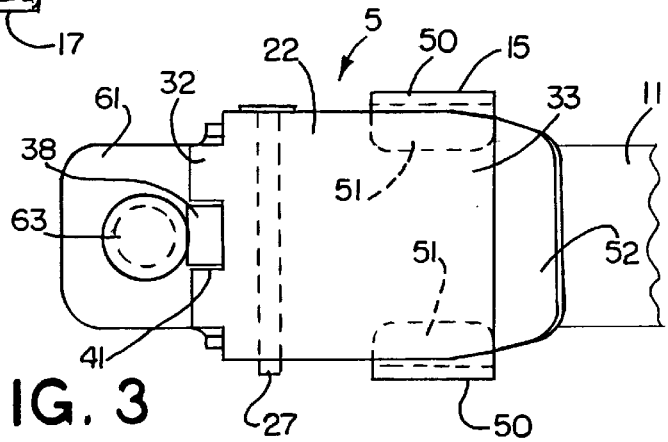
FIG. 3 is a top plan view of the buckle of FIG. 1.

Referring now in detail to the drawings, and initially to FIG. 1, there is shown one known type of reusable pallet system 1 including a bottom pallet 2 and a lid or top cover 3. The top cover 3 is releasably connected to the bottom pallet to restrain a load thereon using two or more reusable cargo restraints 4 each of which may include a buckle 5 made in accordance with the present invention. The bottom pallet 2 is commonly vacuum formed or injection molded out of a suitable plastic material, and has legs 6 on the bottom side to allow a fork lift truck to get under the pallet for transport from one location to another. The top cover 3 may but need not mirror the bottom pallet as desired.

FIG. 1 shows a plurality of tote boxes or trays 8 stacked on the bottom pallet 2, with the top cover 3 placed over the top layer of boxes or trays 8, and secured in place using two or more of the reusable cargo restraints 4 as aforesaid. Each cargo restraint includes, in addition to the buckle 5, a belt retractor 10. Typically the buckles 5 of the respective restraints are attached to the top cover on one side and bottom pallet on the opposite side, and the attachments for the retractors 10 are reversed.

The belt retractors 10 allow the length of the respective belts 11 to be adjusted depending on the height of the load on the pallets. At the outer ends of the belts 11 are tongues 12 for insertion into the buckles 5.

A preferred form of the buckle 5 of the present invention is shown in detail in FIGS. 2 through 6. Such buckle includes a housing 15 formed out of a single piece of sheet metal, preferably steel. At the forward end of the housing 15 is a rearwardly and upwardly angled lip 16 defining with the bottom wall 17 of the housing a slot 18 in which the forward edge of a latch 19 is received to provide a pivotal connection therebetween. The latch 19, like the housing 15, is also formed from a single piece of sheet metal, preferably steel.

Along opposite sides of the housing bottom wall 17 rearwardly of the forward end thereof are upwardly bent ears 20 containing aligned holes 21 for pivotal mounting of a lever 22 to the housing 15 in overlying relation to the latch 19. The lever 22, like the housing 15 and latch 19, is formed from a single piece of sheet metal, preferably steel. On opposite sides of the lever 22 are downwardly bent tabs 25 that extend over the tops of the housing ears 20. Aligned holes 26 in the tabs 25 are aligned with the holes 21 in the ears 20 for receipt of a suitable pin 27 to provide the required pivotal connection between the lever and housing.

Interposed between the bottom wall 17 of the housing 15 and latch 19 is a leaf spring 30 that urges the back edge 31 of the latch 19 away from the housing bottom wall and into engagement with the rear end portion 32 of the lever 22 rearwardly of the pivotal connection 27 between the lever and housing. This in turn urges the front portion 33 of the lever 22 toward the housing bottom wall 17.

At the forward edge of the latch 19 is a notch 35 in which a reversely bent forward end 36 of the leaf spring 30 is received. The leaf spring 30 extends rearwardly beneath the latch 19 and is then bent upwardly to extend above the back edge of the latch. At the upper end of the upwardly extending spring portion 37 is a reversely bent outer end 38 overlying the back edge 31 of the latch 19.

The back edge 32 of the lever 22 is reversely bent rearwardly of the pivotal connection 27 to provide a cam member 40 that presses against the back edge of the latch. Cut part way into the reversely bent back edge 32 of the lever 22 is a slot 41 (see FIGS. 3 and 5) in which the reversely bent upper end portion 38 of the spring 30 is received, permitting the distal end edge 42 of the reversely bent end portion to engage the inside surface of the reversely bent back edge 43 of the lever when the lever is in its closed position shown in FIGS. 4 and 5.

Along opposite sides of the bottom wall 17 of the housing 15 adjacent the forward end thereof are upwardly bent flanges 50 each having inturned edges 51 defining an opening between the inturned edges and upwardly angled lip 16 on the bottom wall 17 for insertion of the belt tongue 12 into the buckle 5. The inturned edges 51 of the flanges 50 also act as stops limiting the extent of downward movement of the forward end 33 of the lever 22 toward the bottom wall 17 of the housing 15. The forward-most edge 52 of the lever 22 is bent upwardly for ease of engagement of the underside by a person's finger during lifting of the forward end 33 of the lever away from the stops 51 to release the tongue 12 from the buckle 5 as described hereafter.

Figure 4:
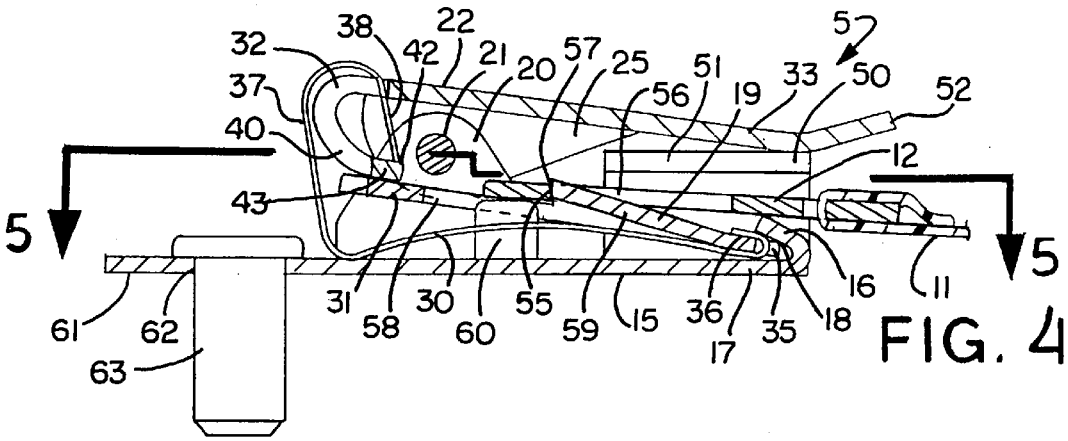
FIG. 4 is an enlarged longitudinal section through the buckle of FIGS. 1 and 2 showing how a tongue of a belt is retained within the buckle.
Figure 5:
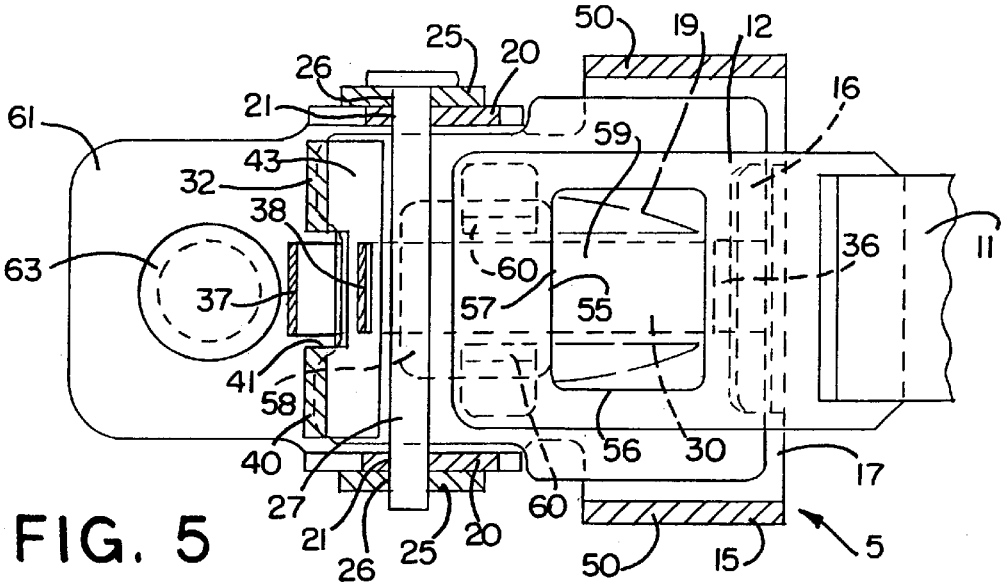
FIG. 5 is a horizontal section through the buckle of FIG. 4, taken on the plane of the line 5—5 thereof.

The tongue 12 is retained within the buckle 5 when the lever 22 is in its lowermost closed position shown in FIGS. 4 and 5 by engagement of the forward wall 55 of a slot 56 in the tongue with a raised rearwardly facing shoulder 57 on the latch 19. Shoulder 57 is formed by an upwardly deformed forward edge of an opening 58 in the latch. The surface 59 of the latch immediately forward of the shoulder 57 is deformed so it gradually slopes upwardly from front to rear to the full height of the shoulder for ease of sliding of the tongue 12 along the latch and into engagement with the shoulder 57. When the tongue 12 is fully seated within the buckle 5, the opening 56 in the tongue receives the gradually sloping surface 59 on the latch and the forward edge 55 of the tongue opening 56 engages the raised shoulder 57 at the forward edge of the latch opening 58 as schematically shown in FIGS. 4 and 5.

Figure 6:
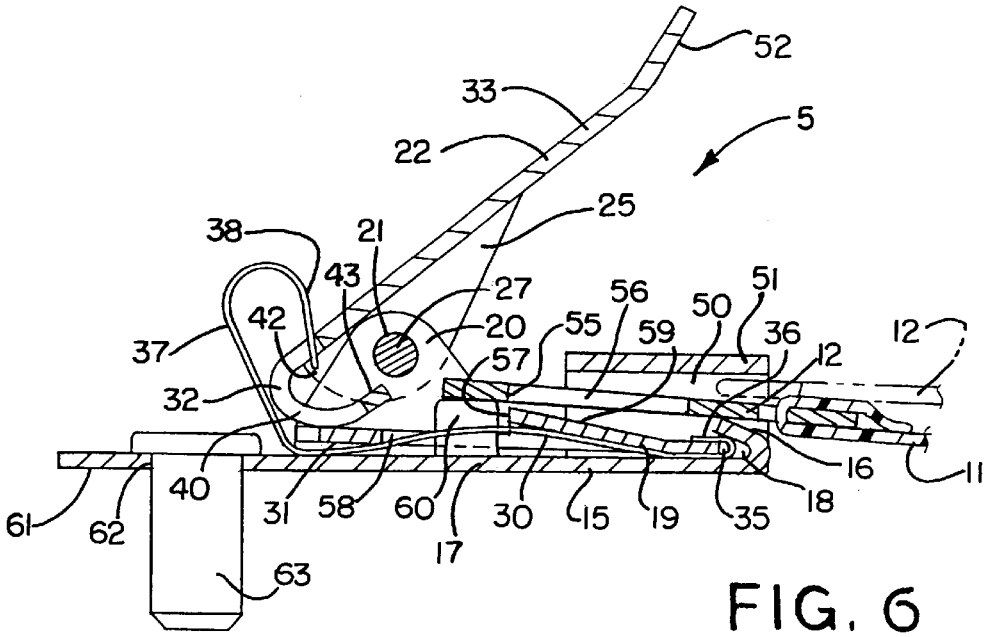
FIG. 6 is an enlarged longitudinal section through the buckle similar to FIG. 4 but showing how the tongue of the belt is released from the buckle.

To release the tongue 12 from the buckle 5, the upwardly bent forward-most edge 52 of the lever 22 is lifted upwardly by a person's finger to cause the cam member 40 on the back edge 32 of the lever to press downwardly against the back edge 31 of the latch 19 as schematically shown in FIG. 6. This causes the back edge of the latch to swing downwardly about its front edge until upstanding projections 60 on the bottom wall 17 of the housing 15 extend through the opening 58 in the latch and force the tongue 12 out of engagement with the rearwardly facing shoulder 57 on the latch thus allowing the tongue to slide out of the buckle as further shown in phantom lines in FIG. 6. The spacing between the upstanding projections 60, which are punched out of the bottom wall 17 of the housing 15, is sufficient for the leaf spring 30 to extend between the projections as schematically shown in FIG. 5.

To facilitate attachment of the buckle 5 to the bottom pallet or top cover 3 or other such support member, the bottom wall 17 of the buckle housing 15 has a rear end portion 61 extending rearwardly of the ears 20 containing a hole 62 for receipt of a suitable fastener 63, which may for example comprise a bolt or welding stud having a threaded shank permanently affixed to the base member.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A buckle for releasably engaging a tongue of a restraint system and the like comprising a housing having a bottom wall, a latch having a forward edge pivotally connected to a forward end of said bottom wall, a lever overlying said latch, said lever having a pivotal connection with said housing intermediate opposite ends of said lever, and a leaf spring between said bottom wall of said housing and said latch for urging a back edge of said latch away from said bottom wall and into engagement with a rear end portion of said lever rearwardly of said pivotal connection between said lever and said housing for urging a front end portion of said lever forwardly of said pivotal connection toward said bottom wall.

2. The buckle of claim 1 wherein said latch has a raised rearwardly facing shoulder engageable by a wall of a slot in the tongue when the tongue is inserted into said buckle between said front end portion of said lever and said latch for retaining the tongue within said buckle.

3. The buckle of claim 2 further comprising an opening through said latch having a raised forward edge forming said rearwardly facing shoulder, and upstanding projections on said bottom wall which extend through said opening in said latch during movement of said latch toward said bottom wall to disengage the tongue from said rearwardly facing shoulder to release the tongue from said buckle.

4. The buckle of claim 3 wherein said latch slopes upwardly from front to rear forwardly of said opening to the full height of said shoulder.

5. The buckle of claim 4 wherein the upward slope of said latch is formed by progressively forming the underside of said latch from front to rear forwardly of said opening.

6. The buckle of claim 3 wherein said leaf spring extends between said upstanding projections on said bottom wall of said housing.

7. The buckle of claim 1 wherein said bottom wall of said housing has upwardly bent ears along opposite sides rearwardly of said forward end of said bottom wall containing aligned holes, and said lever has downwardly bent tabs along opposite sides containing aligned holes in alignment with the holes in said ears, and a pin extends through said aligned holes in said ears and said tabs to provide said pivotal connection between said lever and said housing.

8. The buckle of claim 7 wherein said bottom wall of said housing has a rear end portion extending rearwardly of said ears containing a hole for receipt of a fastener for attaching said buckle to a support member.

9. The buckle of claim 8 wherein said fastener comprises a welding stud permanently affixed to said bottom wall.

10. The buckle of claim 1 wherein said forward end of said bottom wall has a rearwardly and upwardly angled lip defining with said bottom wall a slot in which said forward edge of said latch is received to provide such pivotal connection therebetween.

11. The buckle of claim 1 wherein said forward edge of said latch has a notch in which a reversely bent forward end of said leaf spring is received.

12. The buckle of claim 11 wherein said leaf spring extends beneath said latch and then upwardly above said back edge of said latch, said upwardly extending portion of said leaf spring having a reversely bent outer end overlying said back edge of said latch.

13. The buckle of claim 12 wherein said rear end portion of said lever is reversely bent rearwardly of said pivotal connection to provide a cam surface engaging said back edge of said lever.

14. The buckle of claim 13 wherein said reversely bent rear end portion of said lever has a slot in which said reversely bent outer end of said spring is received.

15. The buckle of claim 14 wherein said reversely bent outer end portion of said spring has a distal end edge engaging an inside surface of said reversely bent rear end portion of said lever when said buckle is closed.

16. The buckle of claim 15 wherein a forward-most portion of said front end portion of said lever is bent upwardly to facilitate engagement of an underside of said forward-most portion by a person's finger for ease of lifting of said front end portion of said lever away from said bottom wall of said housing.

17. The buckle of claim 1 wherein said forward end of said bottom wall has upwardly bent flanges along opposite sides and inturned edges at upper ends of said flanges defining an opening between said flanges and said latch for insertion of the tongue into said buckle.

18. The buckle of claim 17 wherein said front end portion of said lever extends over said inturned edges of said flanges, said inturned edges acting as a stop limiting the extent of movement of said front end portion of said lever toward said bottom wall.

19. The buckle of claim 1 wherein each of said housing, said latch and said lever are formed out of a single piece of sheet metal.

20. A buckle for releasably engaging a tongue of a restraint system and the like comprising a housing, a latch having a forward edge pivotally connected to said housing, a lever overlying said latch, said lever having a pivotal connection with said housing intermediate opposite ends of said lever, a spring for urging a back edge of said latch into engagement with a rear end portion of said lever rearwardly of said pivotal connection between said lever and said housing for urging a front end portion of said lever forwardly of said pivotal connection toward said housing, said forward end portion of said lever being manually movable away from said housing to cause said rear end portion of said lever to press downwardly against said back edge of said latch causing said back edge of said latch to move inwardly within said housing, said latch having a raised rearwardly facing shoulder engageable by a wall of a slot in the tongue when the tongue is inserted into said buckle between said lever and said latch for retaining the tongue within said buckle, and projections on said housing which push the tongue out of engagement with said shoulder on said latch during movement of said latch inwardly within said housing to release the tongue from said buckle.

* * * * *